US010975689B1

(12) United States Patent
Sun et al.

(10) Patent No.: US 10,975,689 B1
(45) Date of Patent: Apr. 13, 2021

(54) NEAR BIT WIRELESS CONSTANT CURRENT SHORT DISTANCE TRANSMISSION METHOD AND DEVICE

(71) Applicant: Institute of Geology and Geophysics, Chinese Academy of Sciences, Beijing (CN)

(72) Inventors: Yuntao Sun, Beijing (CN); Wenxuan Chen, Beijing (CN); Qingyun Di, Beijing (CN); Jian Zheng, Beijing (CN); Wenxiu Zhang, Beijing (CN)

(73) Assignee: Institute of Geology and Geophysics, Chinese Academy of Sciences, Beijing (CN)

( * ) Notice: Subject to any disclaimer, the term of this patent is extended or adjusted under 35 U.S.C. 154(b) by 0 days.

(21) Appl. No.: 17/025,105

(22) Filed: Sep. 18, 2020

(30) Foreign Application Priority Data

Sep. 18, 2019 (CN) ..... 201910882429.0

(51) Int. Cl.
*E21B 47/13* (2012.01)
*E21B 47/013* (2012.01)

(52) U.S. Cl.
CPC ..... *E21B 47/13* (2020.05); *E21B 47/013* (2020.05)

(58) Field of Classification Search
CPC ..... E21B 47/13; E21B 47/013
See application file for complete search history.

(56) References Cited

U.S. PATENT DOCUMENTS 3,831,138 A * 8/1974 Rammner ..... E21B 47/06 367/81
6,469,635 B1 * 10/2002 Hudson ..... H04B 13/02 340/854.4
8,733,431 B2 * 5/2014 Upshall ..... G01V 11/002 166/65.1
2006/0232137 A1 * 10/2006 Bartholomew ..... H02J 9/061 307/66
2012/0268074 A1 * 10/2012 Cooley ..... H01G 2/065 320/130
2013/0057412 A1 * 3/2013 Gard ..... E21B 47/13 340/854.9

(Continued)

FOREIGN PATENT DOCUMENTS

CN 100410488 C 8/2008
CN 202220566 U 5/2012

(Continued)

OTHER PUBLICATIONS

Zhang, Tao et al.; The Design of High-power LED Street Lamp Driver; Light & Lighting; vol. 33, No. 1; Mar. 2009.

(Continued)

*Primary Examiner* — Amine Benlagsir
(74) *Attorney, Agent, or Firm* — Novick, Kim & Lee, PLLC; Allen Xue

(57) ABSTRACT

A near-bit wireless constant current short-distance transmission device has an emission part and a receiving part. The emission part modulates a signal and then wirelessly transmits the modulated signal to the receiving part. The emission part transmits an emission signal into a stratum according to a set rated emission constant current value, and dynamically monitors and adjusts the rated emission constant current value of the emission signal to obtain stable emission power.

8 Claims, 4 Drawing Sheets

(56) References Cited

U.S. PATENT DOCUMENTS

| | | | | |
|---|---|---|---|---|
| 2014/0021825 | A1* | 1/2014 | Ocalan | H02N 2/181 310/300 |
| 2015/0029036 | A1* | 1/2015 | Xiao | E21B 43/128 340/855.3 |
| 2015/0107824 | A1* | 4/2015 | Signorelli | E21B 41/0085 166/244.1 |
| 2016/0003034 | A1* | 1/2016 | Liu | H04L 27/02 340/853.2 |
| 2016/0097268 | A1* | 4/2016 | Okoniewski | E21B 43/2401 166/248 |
| 2016/0146001 | A1* | 5/2016 | Chu | E21B 47/18 367/83 |
| 2018/0058199 | A1* | 3/2018 | Sun | E21B 47/13 |

FOREIGN PATENT DOCUMENTS

| | | | |
|---|---|---|---|
| CN | 102938616 | A | 2/2013 |
| CN | 103061755 | A | 4/2013 |
| CN | 203119782 | U | 8/2013 |
| CN | 106246167 | A | 12/2016 |
| CN | 206299373 | U | 7/2017 |

OTHER PUBLICATIONS

Wei, Huifeng et al.; The Design of High-power LED Street Lamp Driver; Chinese Journal of Power Sources; vol. 5, p. 78-80, 2009.

Xu, Jianwei; High-power LED road lighting system design and driving power research; Electronics World; TU113.666; vol. 24, p. 63 and p. 65, Dec. 23, 2015.

* cited by examiner

NEAR BIT WIRELESS CONSTANT CURRENT SHORT DISTANCE TRANSMISSION METHOD AND DEVICE

FIELD

The present disclosure belongs to the technical field of near-bit logging while drilling, and particularly relates to near-bit wireless constant current short-distance transmission method and device.

BACKGROUND

At present, near-bit logging while drilling technology is developing rapidly. Compared with conventional logging while drilling, a sensor probe of a near-bit logging instrument is closer to a drill bit, and thus can obtain drilling stratigraphic information in time to more accurately mark drilling trajectory, reduce drilling operation risk and improve operation efficiency. Generally speaking, a near-bit logging while drilling (LWD) instrument consists of the following three parts: a near-bit measuring tool, a near-bit short-distance transmission device and a measurement while drilling (MWD) system, as shown in FIG. 1. The near-bit measuring tool is arranged close to the drill bit, and an accelerometer, a magnetic sensor and the like are installed inside the near-bit measuring tool to measure the drilling trajectory information. Some systems are also equipped with a gamma-ray probe and a resistivity measuring tool, which can be used to measure geological information of drilling strata in time. The near-bit short-distance transmission system is composed of an emitter and a receiver, and a screw is bridged between the emitter and the receiver. The function of transmitting the information of the near-bit measuring tool to the MWD system is realized. Due to the structural characteristics of the screw, the screw usually has no electrical connection performance (it is impossible to realize wired communication between transmitting and receiving devices by using a through wire), unless the screw structure is modified and the through wire pre-embedded in the screw is used to realize the wired communication (see the patent number CN201120323832.9), but this structure has its limitations in use and is basically abandoned. The development direction of near-bit short-distance transmission is wireless transmission. Drilling Technology Research Laboratory of China Petroleum Exploration and Development Research Institute adopts an electromagnetic method. The method is that a wireless electromagnetic short-distance transmission signal generator with a transmitting antenna modulates data collected by the near-bit measuring tool to generate electromagnetic signals which are transmitted and output. A wireless electromagnetic short-distance transmission receiver with a receiving antenna receives the transmitted and output electromagnetic signals, demodulates the received electromagnetic signals, and transmits the demodulated data to an MWD measurement system (see patent number CN100410488C). The third part, an MWD system, is mainly composed of a probe tube, a battery and a mud pulse generator. The near-bit short-distance transmission device sends the received near-bit measurement information to a ground system by means of the mud pulse generator for real-time monitoring by field engineers.

In the aspect of wireless short-distance transmission, in addition to transmission by means of a wireless electromagnetism mode, transmission by means of an electrode mode is also adopted. The principle of the transmission by means of the electrode mode is that an emitter, a screw and a receiver are divided into three electrically isolated sections by inserting two GAP insulation layers into the emitter and receiver. Wireless short-distance transmission is realized by detecting weak signals at both ends of the GAP at the receiver by emitting current from the emitter. This method is easy to realize and convenient for machining, and thus has been widely used.

However, in the actual development process, the applicant finds that the power consumption of wireless short-distance transmission by means of the electrode mode is quite different under different strata and mud resistivity conditions. The dynamic range of resistivity (influenced by mud resistivity and stratum resistivity) of the drilling strata (near the bit during drilling) can vary from 0.1 Ω·m to 200 Ω·m. Therefore, if the power output of an emission circuit is not controlled effectively, once the instrument encounters a low-resistivity stratum during drilling, it means that a short circuit occurs at two ends of the emitting GAP, and the power consumption of the emission circuit is very large, which easily causes burning of the emission circuit of the instrument. For example, the applicant has actually measured that the actual equivalent resistance at both ends of the emission electrode is about 10Ω in a mud environment of 1 Ω·m, while the actual equivalent resistance at two ends of the emission electrode is 200Ω in a mud environment of 37 Ω·m (clear water). Therefore, in both of the two kinds of environment, if the emission circuit emits at a constant voltage, the power consumption in the case of low resistance is 20 times that in the case of high resistance. With the decrease of mud resistivity, the difference is larger, which easily results in the burning of the emission circuit. Therefore, a constant-current near-bit emission method and device are mainly proposed, and adjustment can be performed according to the actual drilling situations, so as to avoid the burning of the emission circuit due to excessive power consumption.

At present, the constant current emission technology has not been adopted in the method of near-bit wireless short-distance transmission by means of the electrode mode. However, the disadvantages of non-constant-current mode have been explained above. Therefore, it is necessary to provide a method and device for near-bit wireless short-distance transmission by adopting a constant current emission mode.

SUMMARY

In order to achieve the above purpose, the present disclosure provides a method and a system for near-bit wireless constant current short-distance transmission, in order to avoid the problem of transmission power consumption when drilling strata with different resistivity during drilling, achieve simple structure and easiness in implementation, and effectively avoid circuit damage caused by excessive transmission power consumption.

According to a first aspect of the present disclosure, provided is a near-bit wireless constant current short-distance transmission system which comprises an emission part and a receiving part, the emission part modulates a signal and then wirelessly transmits the modulated signal to the receiving part at a short distance, wherein the emission part emits an emission signal into a stratum according to a set rated emission constant current value, and dynamically monitors and adjusts the rated emission constant current value of the emission signal to obtain stable emission current.

Furthermore, the emission part comprises an emission processor part, a metal-oxide-semiconductor field effect transistor (MOSFET) driving part, a feedback acquisition part, a constant current control part, an H-bridge driving part and an emission electrode, wherein the emission processor part is used for carrying out binary frequency modulation on measurement information of a near-bit measuring tool, generating a constant voltage amplitude signal and controlling the constant current control part to adjust the rated emission constant current value;

the MOSFET driving part is used for amplifying a constant voltage amplitude signal and controlling the H-bridge driving part after being driven by a MOSFET;

the feedback acquisition part is used for monitoring an emission voltage value and an emission current value in real time and feeding the emission voltage value and the emission current value back to the emission processor part for dynamic monitoring and adjustment;

the constant current control part is used for setting the rated emission constant current value, adjusting the rated emission constant current value according to feedback information obtained by the emission processor part, and feeding the adjusted rated emission constant current value back to the emission processor part; and the positive and negative poles of the emission electrode are connected with the two poles of a load of the H-bridge driving part respectively, and emits an emission constant current into the stratum.

Furthermore, the emission processor part sets a constant analog voltage value through an analog output port, and generates a constant voltage amplitude signal after passing through an amplifying circuit.

Furthermore, adjusting the rated emission constant current value by the constant current control part according to the feedback information obtained by the emission processor part specifically comprises the following steps:

when the rated emission constant current value is set to a maximum value during initialization, then, if a total resistance in the circuit is larger than a discharge resistance required by the rated emission constant current value, the constant current control part reduces the rated emission constant current value, and if the total resistance in the circuit is less than the discharge resistance required by the rated emission constant current value, the constant current control part keeps the rated emission constant current value unchanged; and when the rated emission constant current value is set to a minimum value during initialization, then, if the total resistance in the circuit is larger than the discharge resistance required by the rated emission constant current value, the constant current control part increases the rated emission constant current value, and if the total resistance in the circuit is less than the discharge resistance required by the rated emission constant current value, the constant current control part keeps the rated emission constant current value unchanged.

Furthermore, the emission processor part obtains the emission voltage value and the emission current value sent by the feedback acquisition part through analog-to-digital converter interfaces ADC1 and ADC2.

According to a second aspect of the present disclosure, provided is a near-bit wireless constant current short-distance transmission method adopting the near-bit wireless constant current short-distance transmission device according to the above description, comprising the following steps:

step 1, setting a rated emission constant current value by a constant current control part;

step 2, carrying out binary frequency modulation on measurement information of a near-bit measuring tool through an emission processor part and generating a constant voltage amplitude signal;

step 3: amplifying the constant voltage amplitude signal by a MOSFET driving part, and controlling an H-bridge driving circuit after being driven by a MOSFET;

step 4: monitoring an emission voltage value and an emission current value in real time through a feedback acquisition part, and sending the emission voltage value and the emission current value to the emission processor part;

step 5, adjusting, by the constant current control part, the rated emission constant current value according to feedback information obtained by the emission processor part, and feeding the rated emission constant current value back to the emission processor part; and step 6, adjusting, by the emission processor part, an emission constant current by the emission processor part according to the adjusted rated emission constant current value feedback by the constant current control part.

Furthermore, the emission processor part sets a constant analog voltage value through an analog output port, and generates a constant voltage amplitude signal after passing through an amplifying circuit.

Furthermore, the step of adjusting, by the emission processor part, the rated emission constant current value according to the feedback information of the constant current control part specifically comprises the following steps:

when the rated emission constant current value is set to a maximum value during initialization, then if a total resistance in the circuit is larger than a discharge resistance required by the rated emission constant current value, reducing the rated emission constant current value by the constant current control part, and if the total resistance in the circuit is less than the discharge resistance required by the rated emission constant current value, keeping the rated emission constant current value unchanged by the constant current control part; and when the rated emission constant current value is set to a minimum value during initialization, then if the total resistance in the circuit is larger than the discharge resistance required by the rated emission constant current value, increasing the rated emission constant current value by the constant current control part, and if the total resistance in the circuit is less than the discharge resistance required by the rated emission constant current value, keeping the rated emission constant current value unchanged by the constant current control part.

Furthermore, the emission processor part obtains the emission voltage value and the emission current value sent by the feedback acquisition part through analog-to-digital converter interfaces ADC1 and ADC2.

The Present Disclosure has the Following Beneficial Effects:

according to the method and the device for near-bit wireless constant current short-distance transmission provided by the present disclosure, stable power consumption is guaranteed and working time is prolonged by the constant current control part, the condition that the maximum value of the emission current does not exceed a set range in different strata and mud resistivity environments can be ensured, effective wireless communication in different strata and mud environments can be realized, the problem of transmission power consumption when drilling strata with different resistivity in the drilling process is avoided, the structure is simple and implementation is easy, and circuit damage caused by excessive transmission power consumption can be effectively avoided. According to the present disclosure, a constant current emission mode is adopted, which has a great practical value in practical application.

BRIEF DESCRIPTION OF THE DRAWINGS

In order to explain the embodiments of the present disclosure or the technical solution in the prior art more clearly, the accompanying drawings required in the embodiments or the description of the prior art will be briefly introduced below. Obviously, the accompanying drawings in the following description are only some embodiments of the present disclosure, and those skilled in the art can obtain other accompanying drawings according to the structures shown in these accompanying drawings without paying creative labor.

The realization, functional features and advantages of the present disclosure will be further explained with reference to the accompanying drawings in combination with the embodiments.

DETAILED DESCRIPTION OF THE EMBODIMENTS

Exemplary embodiments will be described in detail herein, and examples thereof are shown in the accompanying drawings. When the following description refers to the accompanying drawings, unless otherwise indicated, the same numbers in different accompanying drawings refer to the same or similar elements. The embodiments described in the following exemplary embodiments do not represent all embodiments consistent with the present disclosure. On the contrary, they are merely examples of devices and methods consistent with some aspects of the present disclosure as detailed in the appended claims.

The terms "first", "second", etc., in the specification and claims of the present disclosure are used to distinguish similar objects, and are not necessarily used to describe a specific order or sequence. It should be understood that the data thus used may be interchanged under appropriate circumstances, so that the embodiments of the present disclosure described herein can be implemented, for example, in an order other than those illustrated or described herein. In addition, the terms "include" and "have" and any variations thereof are intended to cover non-exclusive inclusion. For example, a process, method, system, product or equipment including a series of steps or units do not need to be limited to those steps or units explicitly listed, but may include other steps or units not explicitly listed or inherent to these processes, methods, products or equipment.

"Multiple" means including two or more.

It should be understood that the term "and/or" used in the present disclosure is only an association relationship describing the associated objects, indicating that there can be three relationships. For example, A and/or B can indicate that A exists alone, A and B exist simultaneously, and B exists alone.

Figure 1:
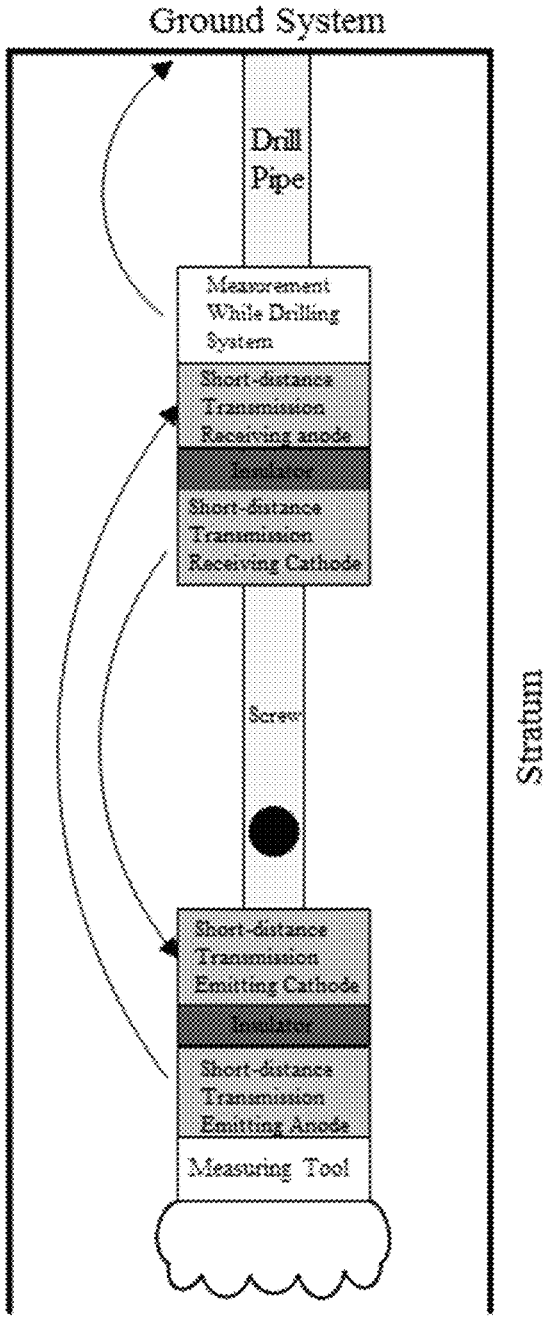
FIG. 1 shows a structural diagram of a near-bit logging while drilling instrument.
Figure 2:
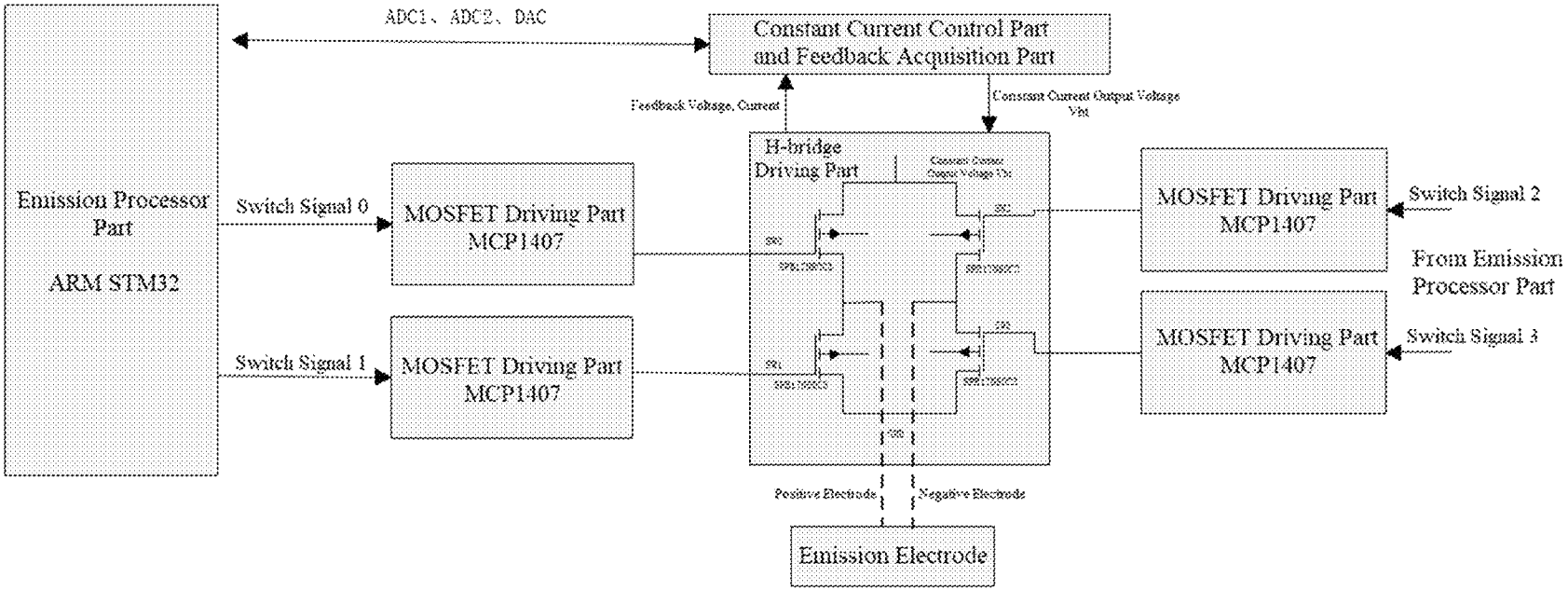
FIG. 2 shows a structural diagram of an emission part of a near-bit wireless constant current short-distance transmission system according to an embodiment of the present disclosure.

The present disclosure discloses a near-bit wireless constant current short-distance transmission device, as shown in FIG. 2, which includes:

an emission processor part used for carrying out binary frequency modulation (2FSK) on measurement information of a near-bit measuring tool, setting a constant analog voltage value and generating a constant voltage amplitude signal after passing through an amplifying circuit;

a MOSFET driving part used for amplifying a modulated signal and controlling an H-bridge driving circuit after being driven by a MOSFET;

a feedback acquisition part used for monitoring an emission voltage and an emission current in real time and feeding the emission voltage and the emission current back to the emission processor part for dynamic monitoring and adjustment;

a constant current control part used for adjusting an emission current value according to feedback information obtained by the emission processor part, and specifically, an output current is adjusted continuously by outputting different voltages by a digital-to-analog converter (DAC) of the emission processor part; and Positive and negative of emission electrodes are bridged with an output end of the H-bridge driving circuit respectively, and emits a preset constant current into the stratum.

Figure 3:
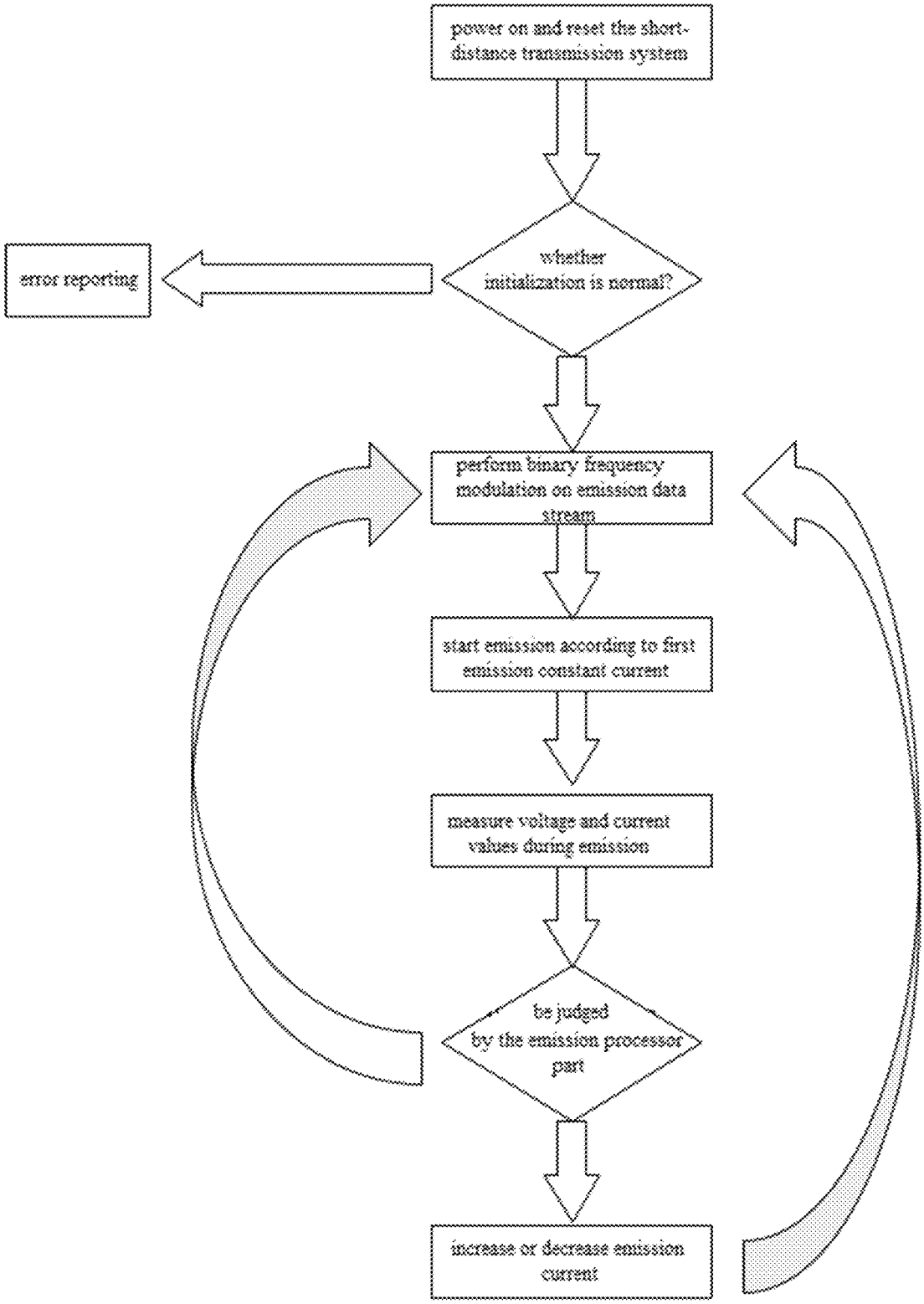
FIG. 3 shows a flow chart of a near-bit wireless constant current short-distance transmission method according to an embodiment of the present disclosure.

The present disclosure further provides a near-bit wireless constant current short-distance transmission method, as shown in FIG. 3, including the following steps.

Step 101, setting a rated (first) emission constant current value by a constant current control part.

Step 102, carrying out binary frequency modulation on measurement information of a near-bit measuring tool through an emission processor part, setting a constant analog voltage value through an analog output port, and generating a constant voltage amplitude signal after passing through an amplifying circuit, wherein the emission processor part obtains an emission voltage value and an emission current value sent by a feedback acquisition part through analog-to-digital converter interfaces ADC1 and ADC2.

Step 103: amplifying the constant voltage amplitude signal by a MOSFET driving part, and controlling an H-bridge driving circuit after being driven by a MOSFET.

Step 104: monitoring the emission voltage value and the emission current value in real time through a feedback acquisition part, and sending the emission voltage value and the emission current value to the emission processor part.

Step 105, adjusting, by the constant current control part, the first emission constant current value according to feedback information obtained by the emission processor part, and feeding the first emission constant current value back to the emission processor part.

The step of adjusting, by the emission processor part, the first emission constant current value according to the feedback information of the constant current control part specifically includes the following steps:

when the rated emission constant current value is set to a maximum value (e.g., 1.0 A) during initialization, if a total resistance in the circuit is larger than a discharge resistance required by the first emission constant current value, the constant current control part reduces the first emission constant current value to a second emission constant current value, and if the total resistance in the circuit is less than the discharge resistance required by the first emission constant current value, the constant current control part keeps the rated emission constant current value unchanged; and when the rated emission constant current value is set to a minimum value (e.g., 0.25 A) during initialization, if the total resistance in the circuit is larger than the discharge resistance required by the first emission constant current value, the constant current control part increases the first emission constant current value to a second emission constant current value, and if the total resistance in the circuit is less than the discharge resistance required by the first emission constant current value, the constant current control part keeps the rated emission constant current value unchanged.

Step 106, adjusting, by the emission processor part, an emission constant current according to the adjusted rated emission constant current value feedback by the constant current control part.

In the technical solution of the present application, the constant current control part is the key to ensure stable power consumption and prolong the working time. Different strata and mud have different resistivity, ranging from 0.1 Ω·m to 200 Ω·m. Real-time monitoring of the emission current and the emission voltage loaded to the stratum ensures that the maximum value of the emission current does not exceed the set range in different strata and mud resistivity environments, effective wireless communication in different strata and mud environments can be realized, and burning of the emission circuit due to a low load can be avoided.

Figure 4:
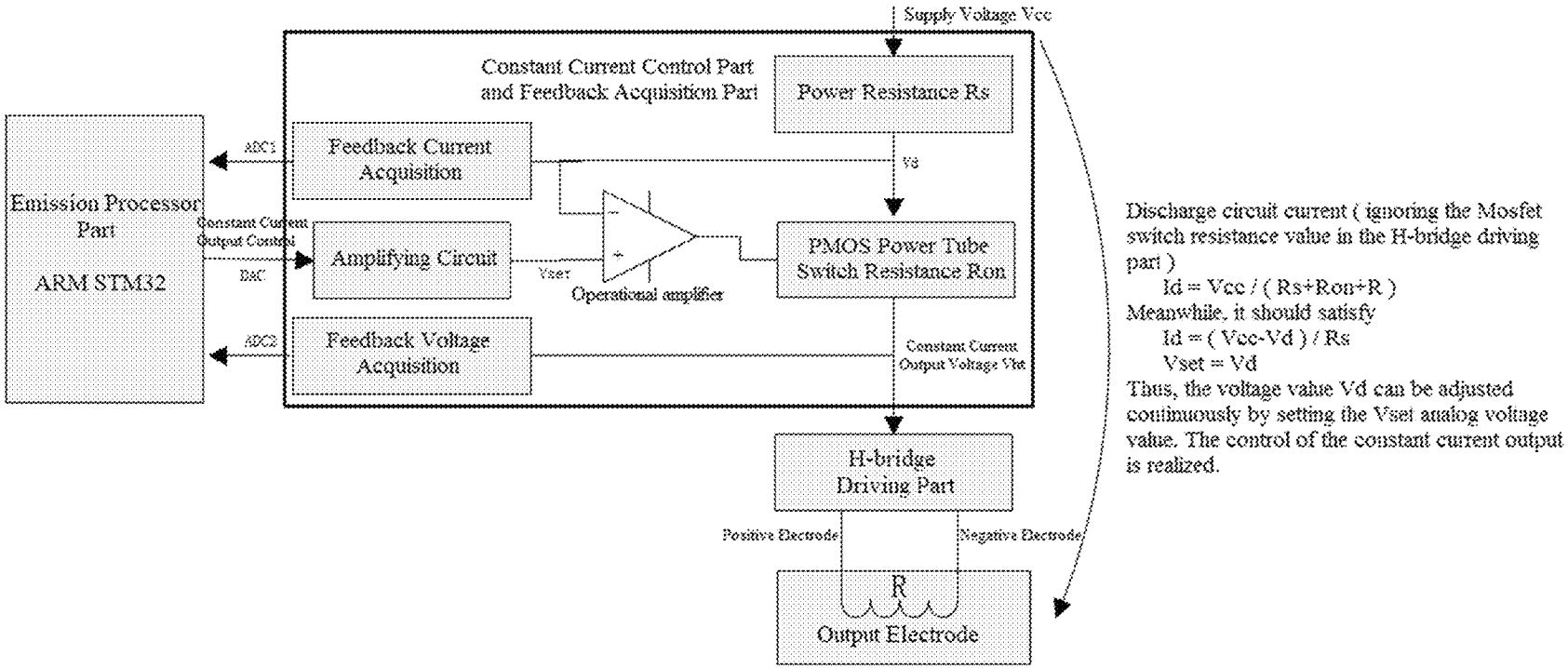
FIG. 4 is a schematic diagram showing the operation of the constant current control part and the feedback acquisition part according to an embodiment of the present disclosure.

As shown in FIG. 4, the emission processor part sets a constant analog voltage value through the analog output port, and generates a constant voltage amplitude signal through the amplifying circuit. The constant voltage amplitude signal is connected with a collector end of a P-channel metal oxide semiconductor (PMOS) power tube to realize a constant current output discharge circuit from a power supply voltage to an H bridge voltage. The constant current discharge circuit includes a power resistance Rs, an H-bridge open-circuit resistance Ron, and a load R at both ends of the emission electrode. If the total resistance of RL=Rs+Ron+R is greater than the discharge resistance required by constant current, the discharge circuit works at a current less than the set constant current. If RL is less than the discharge resistance required by constant current, the discharge circuit works at a set constant current. In this way, it is ensured that the emission circuit cannot be burned under the condition of low stratum resistivity. At the same time, the device has a measuring circuit that feeds back the current and voltage, and can monitor the current of the discharge circuit and the voltage value of the H-bridge high voltage in real time. According to these two measured values, the emission processor part can obtain the present equivalent resistance R at two ends of the emission electrode, so that the apparent resistivity of the currently drilling stratum can be obtained through inversion. The feedback voltage and the feedback current can be simply obtained through analog-to-digital converter interfaces ADC1 and ADC2 of the processor part.

In practical application, the selected power supply voltage and the set constant current directly affect the working time of the system (because the near-bit measuring tool is basically powered by batteries) and a signal-to-noise ratio of a receiving system (different transmission powers and stratum resistivity directly affect the amplitude and signal-to-noise ratio of the received signal). Therefore, setting is performed according to the actual situations. At present, this method and device have been applied to the near-bit electrode wireless short-distance transmission system invented by the inventor.

Embodiment 1

In a system that has been realized at present, the power supply voltage is 11 V, and the emission processor part sets the maximum emission current to be 500 mA. The system sets the collector voltage loaded to a PMOS to be 10 V through a DAC (an analog-to-digital converter output port) of the processor part. The power resistance is selected to be RS=2Ω, so that if RL is less than 22Ω, the maximum current loaded by the system to a high voltage end of an H bridge is 500 mA ((11 V−10 V)/2Ω). Since the discharge circuit current is 500 mA and the power consumption loaded on the Rs power resistance is 0.5*0.5*2=0.5 W, it is necessary for Rs to select a high-power resistance to adapt to a current being 500 mA or above.

Embodiment 2

By reforming the current system, a higher emission current can be obtained, and the power supply voltage is 22 V. The emission processor part sets the maximum emission current to be 2 A. The system sets the collector voltage loaded to a PMOS to be 18 V through a DAC (an analog-to-digital converter output port) of the processor part. The power resistance is selected to be RS=2Ω, so that if RL is less than 11Ω, the maximum current loaded by the system to the high voltage end of an H bridge is 2 A ((22V−18V)/2Ω). Since the discharge circuit current is 2 A, and the power consumption loaded on the Rs power resistance is 2*2*2=8 W, the Rs needs to choose a high-power resistance to adapt to a current being 2 A or above.

Embodiment 3

Under the condition of a high resistivity of the drilling stratum, the power supply voltage is 11 V, and the emission processor part sets the maximum emission current to be 0.5 A. The system sets the collector voltage loaded to a PMOS to be 10 V through a DAC (an analog-to-digital converter output port) of the processor part. The power resistance is selected to be RS=2Ω, so that if RL is less than 22Ω, the maximum current loaded by the system to the high voltage end of an H bridge is 2 A ((22 V−18 V)/2Ω). However, if the present equivalent resistance R at two ends of the emission electrode is large and the total load RL of the discharge circuit is greater than 22Ω, the current of the discharge circuit is less than 500 mA when the discharge circuit works at a current of 11 V/RL.

According to the present disclosure, the constant current emission function of the near-bit measuring tool can be realized, and the practicability is high. The purpose of the present disclosure is to solve the problem of electrode-type emission power under the condition that different strata are actually drilled, so as to avoid the problem that the emission power increases uncontrollably and thus the circuit is burned under the condition of a low-resistance stratum (the lower the resistivity of stratum, the smaller the equivalent resistance at two ends of the emission electrode).

The invention claimed is:

1. A near-bit wireless constant current short-distance transmission system, comprising an emission part and a receiving part, the emission part modulates a signal and then wirelessly transmits the modulated signal to the receiving part, wherein the emission part is configured to emit an emission signal into a stratum according to a rated emission constant current value, and dynamically monitors and adjusts the rated emission constant current value of the emission signal to obtain a stable emission power, wherein the emission part comprises an emission processor, a MOSFET driver circuit having a plurality of MOSFET drivers, a feedback acquisition part, a constant current control part, an emission electrode, an H-bridge circuit, wherein the H-bridge circuit is coupled with the MOSFET driver circuit, the emission electrode, the feedback acquisition part, and the constant current control part, wherein, during operation, the emission processor performs binary frequency modulation on data measured by a near-bit measuring tool, generates a constant voltage amplitude signal, and controls the constant current control part to adjust the rated emission constant current value, the MOSFET driver circuit amplifies the constant voltage amplitude signal received from the emission processor and output a signal to the H-bridge circuit, the feedback acquisition part monitors an emission voltage value and an emission current value through the H-bridge circuit and outputs the emission voltage value and the emission current value to the emission processor, the constant current control part sets the rated emission constant current value, adjusts the rated emission constant current value according to feedback information obtained by the emission processor, and outputs the adjusted rated emission constant current value to the emission processor; and the emission electrode is connected to an output end of the H-bridge circuit and emits an emission constant current into the stratum.

2. The near-bit wireless constant current short-distance transmission system according to claim 1, wherein, during operation, the emission processor sets a constant analog voltage value by an analog output port, and generates a constant voltage amplitude signal after passing through an amplifying circuit.

3. The near-bit wireless constant current short-distance transmission system according to claim 1, wherein, when the rated emission constant current value is set to a maximum value during initialization, then the constant current control part reduces the rated emission constant current value when a total discharge resistance is larger than a value required by the rated emission constant current value, and the constant current control part keeps the rated emission constant current value unchanged when the total discharge resistance is less than the value required by the rated emission constant current value; and when the rated emission constant current value is set to a minimum value during the initialization, then the constant current control part increases the rated emission constant current value when the total discharge resistance is larger than the value required by the rated emission constant current value, and the constant current control part keeps the rated emission constant current value unchanged when the total discharge resistance is less than the value required by the rated emission constant current value, wherein the total discharge resistance comprises a power resistance, an H-bridge open-circuit resistance, and a load at both ends of the emission electrode.

4. The near-bit wireless constant current short-distance transmission system according to claim 1, wherein the emission processor obtains the emission voltage value and the emission current value sent by the feedback acquisition part through first analog-to-digital converter interface (ADC1) and second analog-to-digital converter (ADC2).

5. A near-bit wireless constant current short-distance transmission method, comprising following steps:

step 1, setting a rated emission constant current value by a constant current control part that is part of a near-bit wireless constant current short-distance transmission device, wherein the near-bit wireless constant current short-distance transmission device comprising: an emission part and a receiving part, the emission part modulates a signal and then wirelessly transmits the modulated signal to the receiving part, wherein the emission part is configured to emit an emission signal into a stratum according to the rated emission constant current value, and dynamically monitors and adjusts the rated emission constant current value of the emission signal to obtain a stable emission power, wherein the emission part comprises an emission processor, a MOSFET driver circuit having a Plurality of MOSFET drivers, a feedback acquisition part, the constant current control part, an emission electrode, an H-bridge circuit, wherein the H-bridge circuit is coupled with the MOSFET driver circuit, the emission electrode, the feedback acquisition part, and the constant current control part, wherein, during operation the emission processor performs binary frequency modulation on data measured by a near-bit measuring tool, generates a constant voltage amplitude signal, and controls the constant current control part to adjust the rated emission constant current value, the MOSFET driver circuit amplifies the constant voltage amplitude signal received from the emission processor and output a signal to the H-bridge circuit, the feedback acquisition part monitors an emission voltage value and an emission current value through the H-bridge circuit and outputs the emission voltage value and the emission current value to the emission processor, the constant current control part sets the rated emission constant current value, adjusts the rated emission constant current value according to feedback information obtained by the emission processor, and outputs the adjusted rated emission constant current value to the emission processor; and the emission electrode is connected to an output end of the H-bridge circuit and emits an emission constant current into the stratum;

step 2, carrying out the binary frequency modulation on the feedback information obtained by the near-bit measuring tool by the emission processor and generating the constant voltage amplitude signal;

step 3: amplifying the constant voltage amplitude signal by the MOSFET driver circuit, and controlling the MOSFET driver circuit after being driven by the MOSFET driver circuit;

step 4: monitoring the emission voltage value and the emission current value in real time by the feedback acquisition part, and sending the emission voltage value and the emission current value to the emission processor;

step 5, adjusting the rated emission constant current value by the constant current control part according to the feedback information obtained by the emission processor, and feeding the adjusted rated emission constant current value back to the emission processor; and step 6, adjusting the emission constant current by the emission processor according to the adjusted rated emission constant current value feedback by the constant current control part.

6. The near-bit wireless constant current short-distance transmission method according to claim 5, wherein the emission processor sets a constant analog voltage value through an analog output port, and generates a constant voltage amplitude signal after passing through an amplifying circuit.

7. The near-bit wireless constant current short-distance transmission method according to claim 5, wherein the step 6 further comprises:

when the rated emission constant current value is set to a maximum value during initialization, then reducing the rated emission constant current value by the constant current control part when a total discharge resistance is larger than a value required by the rated emission constant current value, and keeping the rated emission constant current value unchanged by the constant current control part when the discharge resistance is less than the value required by the rated emission constant current value; and when the rated emission constant current value is set to a minimum value during h initialization, then increasing the rated emission constant current value by the constant current control part when the total discharge resistance is larger than the value required the rated emission constant current value, and keeping the rated emission constant current value unchanged by the constant current control part when the total discharge resistance is less than the value required by the rated emission constant current value, wherein the total discharge resistance comprises a power resistance, an H-bridge open-circuit resistance, and a load at both ends of the emission electrode.

8. The near-bit wireless constant current short-distance transmission method according to claim 5, wherein the emission processor obtains the emission voltage value and the emission current value sent by the feedback acquisition part through analog-to-digital converter interface (ADC1) and second analog-to-digital converter (ADC2).

* * * * *